United States Patent [19]

Sweet et al.

[11] Patent Number: 4,932,545

[45] Date of Patent: Jun. 12, 1990

[54] SHIPPING CONTAINER

[76] Inventors: James L. Sweet, 4480 E. Balsam La., Rhinelander, Wis. 54501; William C. Yardley, 10101 S. Seeley, Chicago, Ill. 60643; Henry E. Bergen, 570 Ruggles St., Fond du Lac, Wis. 54935

[21] Appl. No.: 336,362

[22] Filed: Apr. 11, 1989

[51] Int. Cl.[5] ..... B65D 19/00

[52] U.S. Cl. ..... 220/1.5; 206/599; 206/600

[58] Field of Search ..... 206/600, 599; 220/1.5

[56] References Cited

U.S. PATENT DOCUMENTS

| | | | |
|---|---|---|---|
| 2,806,594 | 9/1957 | Muller et al. | 206/600 |
| 3,315,800 | 4/1967 | Wagner | 206/600 |
| 3,949,874 | 4/1976 | Heavner | 206/600 |
| 4,311,239 | 1/1982 | Schlicker | 206/600 |
| 4,697,699 | 10/1987 | Schneider | 206/600 |
| 4,785,957 | 11/1988 | Beck et al. | 206/600 |
| 4,793,807 | 11/1988 | DelPlanque | 206/600 |

*Primary Examiner*—Joseph Man-Fu Moy

*Attorney, Agent, or Firm*—Michael D. Rechtin; Philip P. Mann

[57] ABSTRACT

A container for shipping bulky and/or heavy objects. The container includes a skid portion with a base panel and support frame, and skid runners are coupled to the exterior of the base panel. A cradle is fixedly coupled to the skid portion and a plurality of side and end panel portions with coupling devices join the side and end panels to the skid support frame. A cover portion fits within the side and end panels to provide a smooth exterior surface, and handling straps bind the container portions together.

20 Claims, 3 Drawing Sheets

Fig. 2B
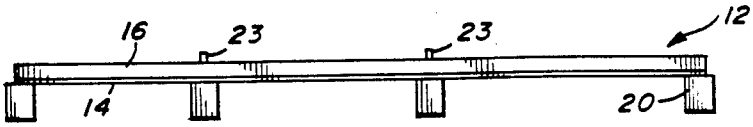
Fig. 2C
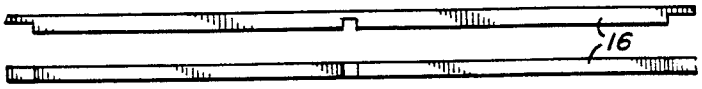
Fig. 2D
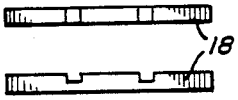
Fig. 3A
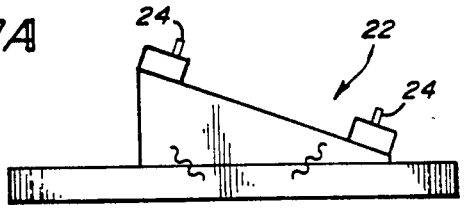
Fig. 3B
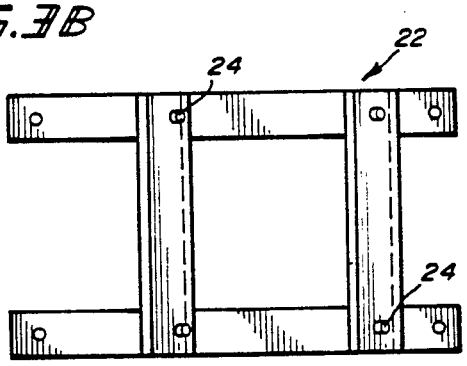
Fig. 4B
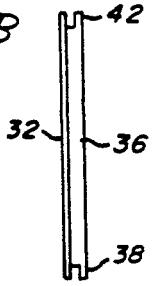
Fig. 4A
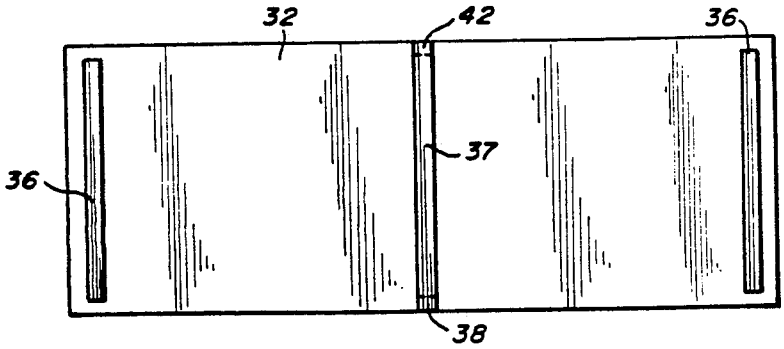
Fig. 5A
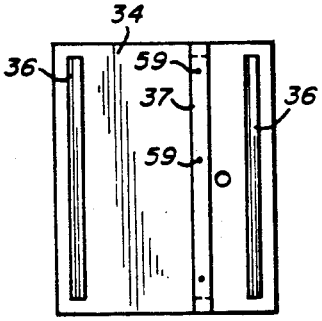
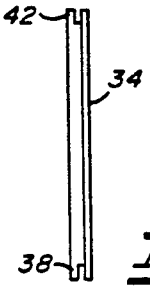
Fig. 5B
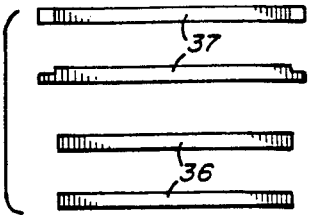
Fig. 5C

SHIPPING CONTAINER

This invention is generally related to a container for shipping bulky and/or heavy objects and more particularly is related to a shipping container which has a high resistance to impact forces experienced during shipment, retains its strength and functionality when subjected to rain or snow and allows easy access to the interior of the container for in-transit review of the contents and/or inclusion of additional materials, such as peripheral components and foreign language instructions.

Conventional shipping containers are constructed of wood or corrugated container. While corrugated boxes are inexpensive and easy to store, they have low wet strength, cannot withstand more than moderate impact forces during shipment and cannot support large static forces during storage. In the case of conventional wooden containers, their assembly usually requires the use of numerous fasteners which makes opening and closing of the containers particularly difficult, thus discouraging any in-transit review of the container contents or the inclusion of additional components. Some wooden containers include numerous components to enhance strength, such as metal corner caps, wire cable reinforcement and extensive use of wood framing members. Such structures complicate the manufacture of the container, increase the manufacturing cost and require substantial time to assemble and dismantle.

BRIEF SUMMARY OF THE INVENTION

It is therefore an object of the invention to provide an improved shipping container.

It is another object of the invention to provide a new shipping container having improved resistance to shipping abuse and weather conditions.

It is an additional object of the invention to provide an improved shipping container allowing easy access to the container interior.

It is a further object of the invention to provide a novel shipping container with a skid portion integral thereto, while providing skid runners on a smooth external face of a base panel of the shipping container.

It is another object of the invention to provide an improved shipping container minimizing the number of components while optimizing the usable space within the container.

A feature of the shipping container in accordance with the invention lies in the accessibility to the interior of the container, the ability to assemble the majority of the container structure without hand tools, the minimization of components in the container, the optimization of usable space and its structurally enhanced impact strength and retention of strength and integrity when the container is subjected to rain or snow. The container includes a skid portion with a base panel and a support frame coupled to the face of the base panel. The support frame is internal to the container and skid runners are fastened to the smooth external face of the base panel. A cradle is fastened to the base panel and the skid runners, and the cradle is further coupled to and supports the object being shipped. A plurality of side and end panel portions are included, and each of the side and end panel portions are supported by coupling a tongue portion of a panel support member to a recessed portion of the skid support frame. The various internal support members are selectively positioned to optimize the usable space for the object being shipped. A cover portion is then fit to the side and end panel portions in substantially the same way as the side and end panel portions fit within the skid portion in the manner described hereinbefore. This coupling arrangement provides a smooth exterior surface for the side and end panel portions and cover portion of the container. A corrugated box having an open bottom can selectively be used to envelop the plurality of side and end panel portions and the cover portion. Bundling straps are then used (with or without the corrugated box being used) for firmly binding together the skid portion, the side and end panel portions and the cover portion.

Further objects and advantages of the invention, together with the organization and the manner of operation thereof, will become apparent from the following detailed description of the invention when taken in conjunction with the accompanying drawings wherein like referenced numerals designate like elements throughout the several views.

BRIEF DESCRIPTION OF THE DRAWINGS

FIG. 2B is a front elevation of the skid portion; FIG. 2C includes a plan and a front elevation view of a longitudinal framing member of the skid portion; and FIG. 2D includes a plan and front elevation view of a transverse framing member of the skid portion;

FIG. 3A is a front elevation of a shipping cradle and frame for fastening to a base panel and skid runner of a shipping container and FIG. 3B is a plan view of the shipping cradle;

FIG. 4A is a front elevation of a longitudinal side panel of a shipping container and FIG. 4B is a side elevation of the longitudinal side panel;

FIG. 5A is a front elevation of a first transverse end panel of a shipping container; FIG. 5B is a side elevation of the transverse end panel and FIG. 5C includes a side and a plan view of various frame members for the end panels;

DESCRIPTION OF PREFERRED EMBODIMENT

Figure 1A:
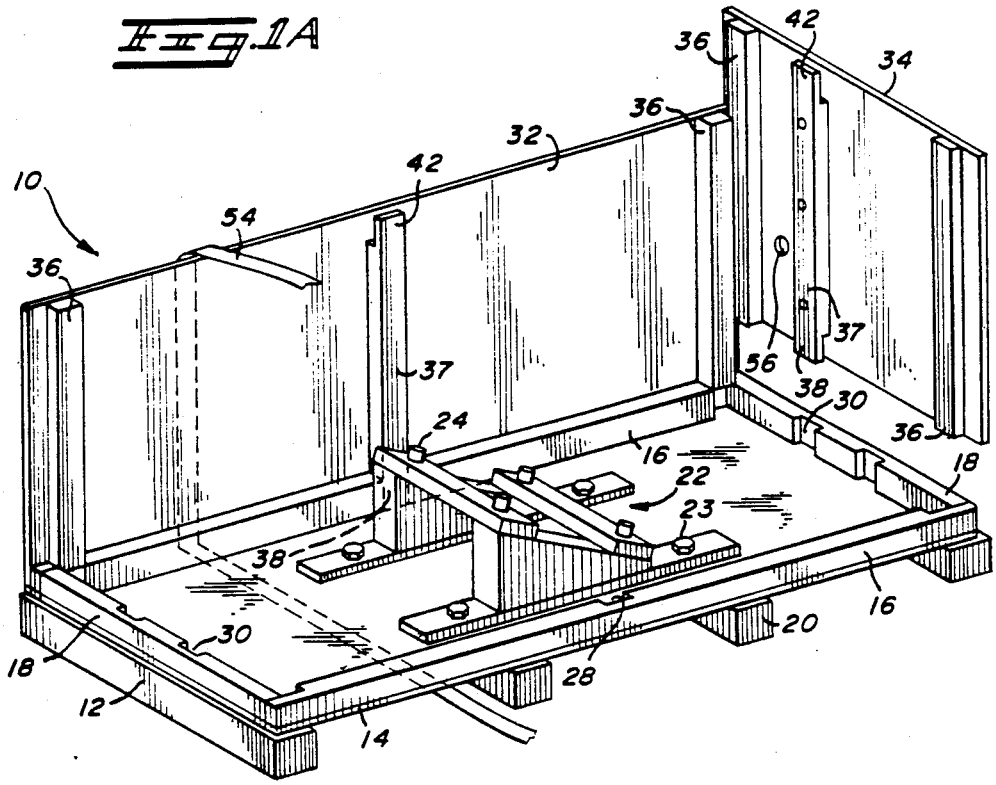
FIG. 1A is a perspective view of a partially assembled shipping container and FIG. 1B is an open bottom corrugated box.

Referring to the drawings, there are illustrated various aspects and components of a shipping container 10. As illustrated in FIG. 1, the shipping container 10 is shown in a partially assembled state in order to best illustrate the components. FIGS. 2–7 illustrate various components of the container 10. The container 10 includes a skid or pallet portion 12 and a base panel 14 with a skid support frame fastened to the inside face of the base panel 14. The support frame is comprised of a longitudinal skid support frame member 16 (hereinafter, "frame member 16") and a transverse skid support frame member 18 (hereinafter, "frame member 18"). Skid runners 20 are coupled to the smooth exterior face of the base panel 14, enabling a fork-lift truck to easily pick up the container without interference from any cross support members or a discontinuous support member structure. The base panel 14 preferably is a pressed wood chip board but can be any such equivalent material. The longitudinal and transverse frame members 16 and 18 are conventional wood framing lumber. As shown in FIG. 3, a shipping cradle 22 is fixedly coupled by fasteners 23 to the base panel 14 and skid runners 20 of the skid portion 12. The cradle 22 is adapted to support and rigidly hold the object being shipped and acts to spread the weight of the object over the entire skid portion 12. Fasteners 24 in FIG. 3A are used to rigidly couple the object to the cradle 22. The container can be used to hold any appropriate size object, such as an outboard motor, by mounting to the cradle 22, or like mounting fixture.

Figure 6A:
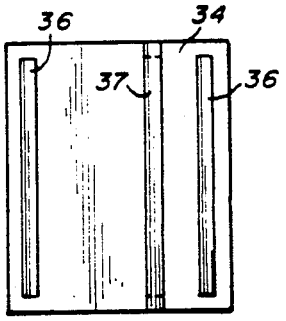
FIG. 6A is a front elevation of a second transverse end panel of a shipping container.
Figure 6B:
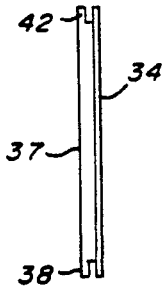
FIG. 6B is a side elevation of a transverse end panel and FIG. 6C includes a side and plan view of various frame members for the end panel.
Figure 6C:
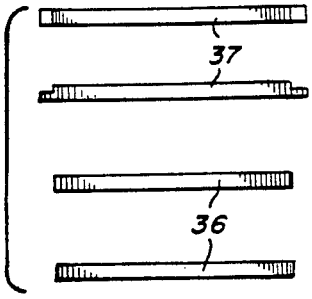
Figure 7A:
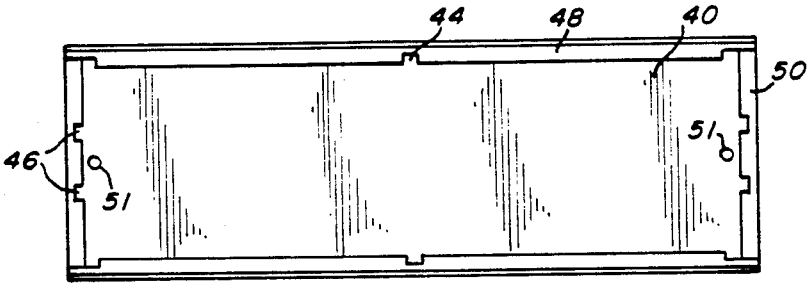
FIG. 7A is a plan view of a cover portion of a shipping container.
Figure 7B:
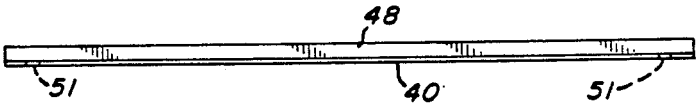
FIG. 7B is a side elevation of a cover portion.
Figure 7C:
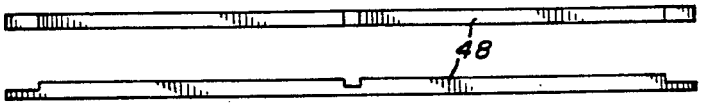
FIG. 7C includes a plan and side elevation view of a longitudinal frame member for the cover portion.
Figure 7D:
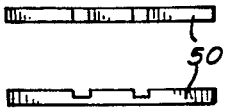
FIG. 7D includes a plan and side elevation view of a transverse frame member for the cover portion.

The frame members 16 and 18 have recessed lower portions 28 and 30 which function to support longitudinal side panel portions 32 and end panel portions 34, respectively, as shown in detail in FIGS. 4–6. Each of the panel portions 32 and 34 have lateral support members 36, and the end panel portions 34 also have an off-center lateral support member 37 (hereinafter, "support member 37"). Each of these support members 36 and 37 have a lower tongue portion 38 constructed to fit within the appropriate recessed portions of the frame members 16 and 18 and act to support the panel portions 32 and 34.

In the end panel portions 34 the support member 37 is offset from center in order to allow the user to assemble container 10 using the end panel portion 34 in either the up or down position. Therefore, the two recessed portions (indicated by 30A and 30B in FIGS. 1A and 2) function to receive the tongue portion 38 regardless of whether the end panel 34 is in the up or down position. Another advantage derived from using an off-center position for the support member 31 is the additional space made available in the vicinity of the center line of the container 10. For example, an outboard motor housing can extend up to the inside surface of the end panel portion 34, thus avoiding the need to enlarge the container 10 by twice the thickness of the support member 37. This optimum use of space in the container 10 reduces the material and cost to produce the container 10.

Once the side and end panel portions 32 and 34 are installed, a cover portion 40 (see FIG. 7) is fitted within the space defined by the panel portions 32 and 34. As shown in FIGS. 4B, 5B and 6B, the side and end panel portions 32 and 34 include upper tongue portions 42. These upper tongue portions 42 fit within recessed upper cover portions 44 and 46 in longitudinal and transverse cover members 48 and 50, respectively, in substantially the same manner as the side and end panel portions 32 and 34 are fitted to the skid portion 12. The cover portion 40 can also include a cover access hole 51 (see FIG. 7A) which allows rapid removal of the cover portion 40 during disassembly, further improving the ease and rapidity of handling operations.

Figure 1B:
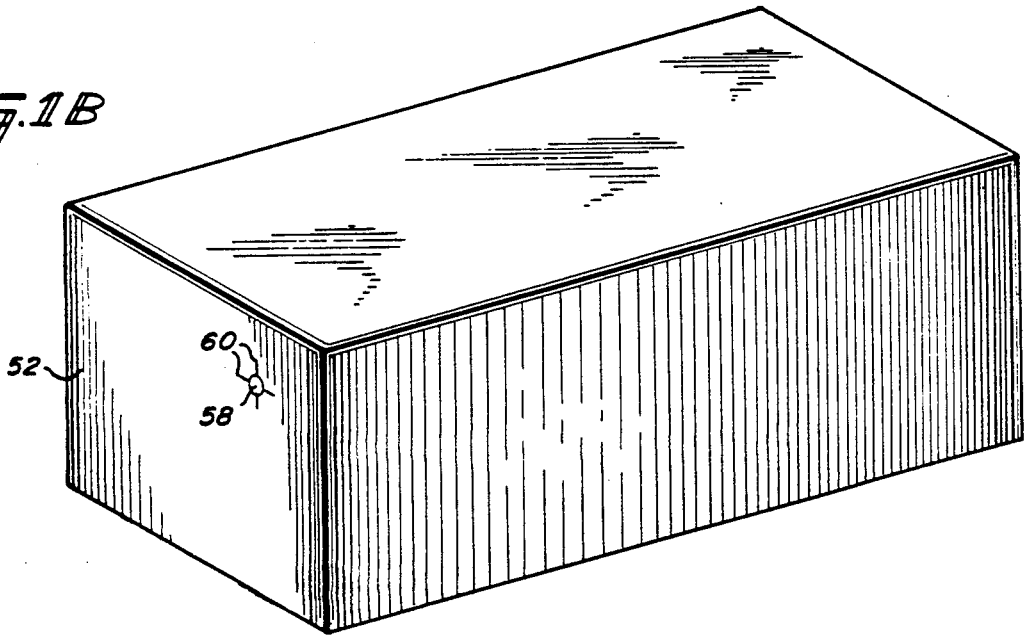
Figure 2A:
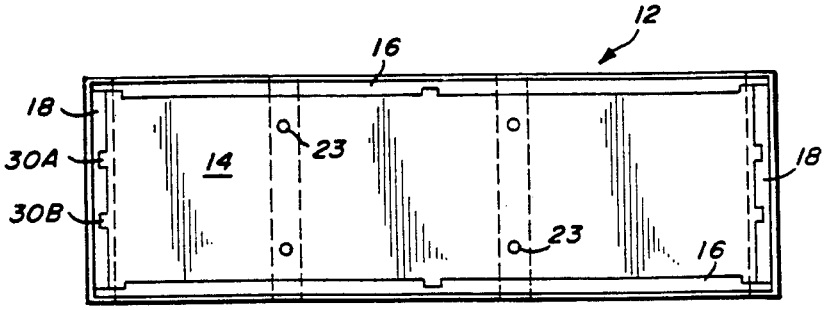
FIG. 2A is a plan view of a bottom or skid portion of a shipping container.

In another form of the invention, the container 10 includes an outer layer of a corrugated box 52 as shown in FIG. 1B. The corrugated box 52 has an open bottom face (facing up in FIG. 1B) so the corrugated box 52 can be slipped over the side and end panel portions 32 and 34 and also over the cover portion 40. This exterior corrugated box structure serves as an additional layer of protection to absorb and soften impact forces experienced during shipping of the container 10. The box 52 also provides additional strength and rigidity to the container 10 by virtue of enveloping a strong wooden interior structure. The box 52 can also be a water resistant cardboard material in order to enhance wet strength, although the use of the previously described wood interior structure and the cardboard sleeving provide excellent wet strength.

Aside from anchoring the cradle to the skid portion 12 and coupling the object to the cradle 22, assembly of the container 10 itself requires no machine or hand tools, is straightforward and requires no adjustments, which is, however, common on many prior art containers. These features enable fast and efficient assembly for shipment of the object.

Conventional bundling straps 54 are shown in FIG. 1 and can be used to establish an extremely secure, rigid state for the components of the container 10. In some forms of the invention the corrugated box 52 is not used, and the bundling straps 54 can be attached directly around the inner wood portion comprising the skid portion 12, the side and end panel portions 32 and 34 and the cover portion 40.

During transit of the container 10, an intermediate shipper may wish to include additional instructions (such as foreign language instructions) or include country specific components or other accessories. This can readily be accomplished by pushing the material through a taped over access portal 56 in the end panel portion 34 as shown in FIG. 1A. If the corrugated box 52 is used, a small access hole 58 on the corrugated box 52 (see FIG. 1B) is in alignment with the access portal 56. The corrugated box 52 includes cross hatched slits 60 passing through the center of the access hole 58. This structure on the box 52 enables easy placement of material into the container 10. The access hole 58 and the slits 60 can then be sealed with tape after inserting components into the container 10. The container 10 also can include a removable form of the center lateral support member 37. If using the corrugated box 52, the shipper first cuts open the end flap of the corrugated box 52 and removes three screw fasteners 59 (see FIG. 1A) on the end panel portion 34 which allows removal of the end panel 34. This enables the complete inspection of the interior of the container 10 and removal or addition of larger components to the container 10.

While preferred embodiments of the present invention have been illustrated and described, it will be understood that changes and modifications can be made therein without departing from the invention in its broader aspects. Various features of the invention are defined in the following claims.

What is claimed is:

1. A container for shipping an object, comprising:

a skid portion having a base panel and a support frame coupled to the face of said base panel internal to said container and skid runners coupled to the smooth external face of said base panel of said skid portion;

a cradle fixedly coupled to said skid portion and further coupled to and supporting said object;

a plurality of side and end panel portions, coupling means joining each of said side and end panel portions to said skid support frame;

a cover portion adapted to fit within said side and end panel portions to provide a smooth exterior surface for said side and end panel portions and said cover portion of said container; and bundling straps for binding together said skid portion, said side and end panel portions and said cover portion.

2. The container as defined in claim 1 wherein selected ones of said side and end panel portions include lateral support members disposed at locations to optimize usable space for said object being shipped.

3. The container as defined in claim 1 wherein said cradle is fastened to said base panel and said skid runners.

4. The container as defined in claim 1 wherein said base panel and said plurality of side and end panel portions comprise pressed wood chip material.

5. The container as defined in claim 4 wherein each of said plurality of side and end panel portions further includes selected support members.

6. The container as defined in claim 1 wherein selected components of said container can be assembled without hand and machine tools.

7. The container as defined in claim 1 wherein said coupling means comprises a tongue portion on said side and end panel portions.

8. The container as defined in claim 7 wherein said coupling means further comprises recessed lower portions of said skid support frame, said recessed lower portions receiving said tongue portions.

9. A container for shipping an object comprising:

a skid portion having a base panel and a support frame coupled to on the face of said base panel internal to said container and skid runners coupled to the smooth external face of said base panel of said skid portion;

a cradle fixedly coupled to said skid portion and further coupled to and supporting said objects;

a plurality of side and end panel portions, each of said panel portions adapted to fit within a channel in said support frame of said skid portion;

a cover portion adapted to fit within said side and end panel portions to provide a smooth exterior surface for said side and end panel portions and said cover portion of said container;

a corrugated box having an open bottom fitted over both said plurality of side and end panel portions coupled to said skid portions and over said cover portion fitted within said side and end panel portions; and bundling straps for binding together said skid portion, said side and end panel portions and said cover portion.

10. The container as defined in claim 9 wherein said cradle is fastened to said base panel and said skid runners.

11. The container as defined in claim 9 wherein said corrugated box is moisture resistant.

12. The container as defined in claim 9 wherein one of said side panels portions includes an access portal.

13. The container as defined in claim 12 further including a small access hole in said corrugated box aligned with said access portal, said small access hole having cross hatched slits passing through said access hole enabling placement into said container of items the size of said access portal.

14. The container as defined in claim 9 wherein a portion of said corrugated box is openable and at least one of said end panel portions is removable, enabling access to the interior of said container.

15. The container as defined in claim 14 wherein said removable end panel portion includes a center lateral support member coupled by fasteners to said removable end panel portion.

16. A container for shipping an object comprising:

a skid portion having a base panel and a support frame coupled to the face of said base panel internal to said container and skid runners coupled to the external face of said base panel of said skid portion;

a cradle fixedly coupled to said skid portion and further coupled to and supporting said objects;

a plurality of side and end panel portions, each of said panel portions adapted to couple to said support frame of said skid portion;

a plurality of side and end panel portions adapted to fit within an appropriate channel of said skid portions, said panel portions including a removable end panel portion allowing access to the interior of said container, a cover portion adapted to fit within said side portions to provide a smooth exterior surface for said side and cover portions of said container; and bundling straps for binding together said skid portion, said side panel portions and said cover portion.

17. The container as defined in claim 16 wherein coupling means connects said panel portions to said support frame.

18. The container as defined in claim 17 wherein said coupling means comprises a tongue portion of said side and end panel portions in conjunction with lower recessed portions of said skid support frame.

19. The container as defined in claim 16 wherein at least one of said end panel portions includes lateral support members disposed at locations to optimize usable space for said object being shipped.

20. The container as defined in claim 16 wherein said cover portion is fitted to said side and end panel portions by a tongue portion on said side portions in conjunction with recessed upper portions of said cover portion.

* * * * *